US008139969B2

(12) United States Patent
Amico et al.

(10) Patent No.: US 8,139,969 B2
(45) Date of Patent: Mar. 20, 2012

(54) APPARATUSES USEFUL IN PRINTING, PRINTING APPARATUSES AND METHODS OF FIXING MARKING MATERIAL ON MEDIA

(75) Inventors: Mark Steven Amico, Pittsford, NY (US); Martin Franklin Zess, Churchville, NY (US)

(73) Assignee: Xerox Corporation, Norwalk, CT (US)

( * ) Notice: Subject to any disclaimer, the term of this patent is extended or adjusted under 35 U.S.C. 154(b) by 278 days.

(21) Appl. No.: 12/473,547

(22) Filed: May 28, 2009

(65) Prior Publication Data

US 2010/0303494 A1 Dec. 2, 2010

(51) Int. Cl.
*G03G 15/20* (2006.01)

(52) U.S. Cl. ..... 399/68; 399/388; 399/396

(58) Field of Classification Search ..... 399/68, 399/388, 396

See application file for complete search history.

(56) References Cited

U.S. PATENT DOCUMENTS

2003/0202809 A1* 10/2003 Tanaka ..... 399/68
2007/0071529 A1* 3/2007 Lee et al. ..... 399/400
2008/0037069 A1 2/2008 Mestha et al.

* cited by examiner

*Primary Examiner* — Ryan Walsh
(74) *Attorney, Agent, or Firm* — Ronald E. Prass, Jr.; Prass LLP

(57) ABSTRACT

Apparatuses useful in printing, printing apparatuses and methods of fixing marking material on media are provided. An exemplary embodiment of the apparatuses useful in printing includes a marking device; a first transport device which transports a first medium and a successive second medium to the marking device in a process direction with the first medium and second medium separated from each other by a first inter-document zone in the process direction; a fixing device including a first member including a first outer surface and a second member including a second outer surface forming a nip with the first outer surface; a second transport device which transports the first medium and second medium from the marking device to the nip; and a controller configured to control a speed of the marking device, the first member and the second transport device to reduce the first inter-document zone between the first medium and second medium to a second inter-document zone in the process direction between the marking device and the nip.

22 Claims, 3 Drawing Sheets

APPARATUSES USEFUL IN PRINTING, PRINTING APPARATUSES AND METHODS OF FIXING MARKING MATERIAL ON MEDIA

BACKGROUND

Some printing apparatuses include a nip formed by opposed members. In such apparatuses, media are fed to the nip and contacted by the members to treat marking material on the media to form prints.

It would be desirable to provide apparatuses useful in printing, printing apparatuses and methods of fixing marking material on media that can produce prints having a desirable gloss.

SUMMARY

Apparatuses useful in printing, printing apparatuses and methods of fixing marking material on media are provided. An exemplary embodiment of the apparatuses useful in printing comprises a marking device; a first transport device which transports a first medium and a successive second medium to the marking device in a process direction with the first medium and second medium separated from each other by a first inter-document zone in the process direction; a fixing device comprising a first member including a first outer surface and a second member including a second outer surface forming a nip with the first outer surface; a second transport device which transports the first medium and second medium from the marking device to the nip; and a controller configured to control a speed of the marking device, a speed of the first member and a speed of the second transport device to reduce the first inter-document zone between the first medium and second medium to a second inter-document zone in the process direction between the marking device and the nip.

DRAWINGS

DETAILED DESCRIPTION

Figure 1:
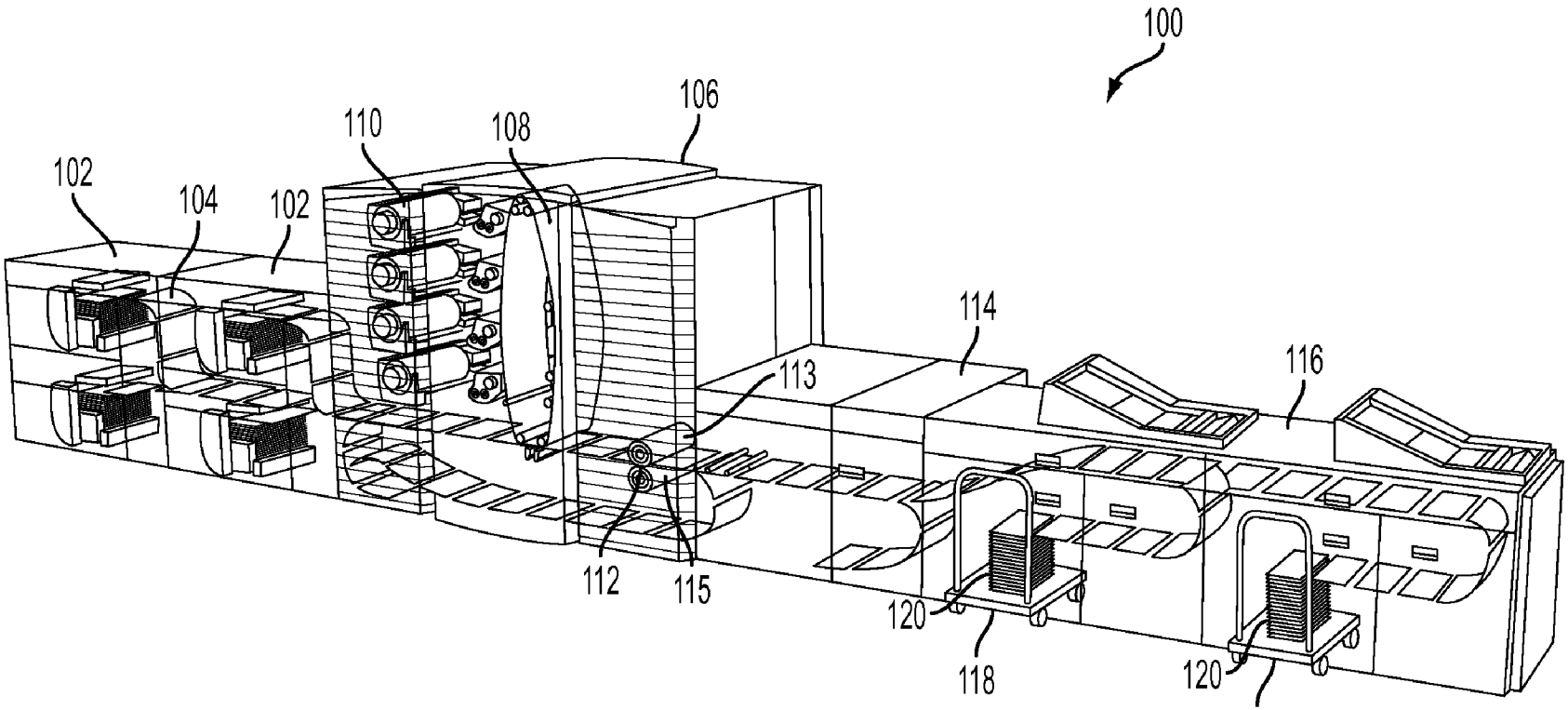
FIG. 1 depicts an exemplary embodiment of a printing apparatus.

The disclosed embodiments include an apparatus useful in printing comprising a marking device; a first transport device which transports a first medium and a successive second medium to the marking device in a process direction with the first medium and second medium separated from each other by a first inter-document zone in the process direction; a fixing device comprising a first member including a first outer surface and a second member including a second outer surface forming a nip with the first outer surface; a second transport device which transports the first medium and second medium from the marking device to the nip; and a controller configured to control a speed of the marking device, a speed of the first member and a speed of the second transport device to reduce the first inter-document zone between the first medium and second medium to a second inter-document zone in the process direction between the marking device and the nip.

The disclosed embodiments further include a printing apparatus comprising a marking device; a first transport device which transports a first medium and a successive second medium to the marking device in a process direction with the first medium and second medium separated from each other by a first inter-document zone in the process direction; a fuser including a rotatable first member including a first outer surface and a rotatable second member including a second outer surface forming a nip with the first outer surface, at least one of the first outer surface and the second outer surface being heated; a second transport device which transports the first medium and second medium from the marking device to the nip; and a controller configured to control a speed of the marking device, a speed of the first member and a speed of the second transport device to reduce the first inter-document zone between the first medium and second medium to a second inter-document zone in the process direction between the marking device and the nip.

The disclosed embodiments further include a method of fixing marking material on media comprising transporting a first medium and a successive second medium to a marking device in a process direction with the first medium and second medium separated from each other by a first inter-document zone in the process direction; applying a marking material to the first medium and second medium with the marking device; transporting the first medium and second medium from the marking device to a nip formed by a first outer surface of a first member and a second outer surface of a second member; and controlling a speed of the marking device, a transport speed of the first medium and second medium from the marking device to the nip, and a speed of the first member to reduce the first inter-document zone between the first medium and second medium to a second inter-document zone in the process direction between the marking device and the nip.

As used herein, the term "printing apparatus" encompasses apparatuses including digital copiers, apparatuses using electrophotographic marking techniques or ink-jet marking techniques, bookmaking machines, multifunction machines, and the like, or portions of such apparatuses, that perform a print outputting function for any purpose. The printing apparatuses can use various types of solid and liquid marking materials, and can treat these marking materials using various process conditions to form images on different types of media.

FIG. 1 illustrates an exemplary printing apparatus 100 disclosed in U.S. Patent Application Publication No. 2008/0037069, which is incorporated herein by reference in its entirety. The printing apparatus 100 can be used to produce prints from various types of media, such as coated or uncoated paper sheets. The media can have various sizes and weights. In embodiments, the printing apparatus 100 includes two media feeder modules 102 arranged in series, a printer module 106 adjacent to the media feeding modules 102, an inverter module 114 adjacent to the printer module 106, and two stacker modules 116 arranged in series adjacent to the inverter module 114.

In the printing apparatus 100, the media feeder modules 102 feed media to the printer module 106. In the printer module 106, marking material (toner) is transferred from a series of developer stations 110 to a charged photoreceptor belt 108 to form toner images on the photoreceptor belt 108. The toner images are transferred to one side of respective media 104 fed through the paper path. The media are advanced through a fuser 112 including opposed rolls 113, 115 forming a nip to fix the toner images on the media. The inverter module 114 manipulates media exiting the printer module 106 by either passing the media through to the stacker modules 116, or inverting and returning the media to the printer module 106. In the stacker modules 116, the printed media are loaded onto stacker carts 118 to form stacks 120.

In printing apparatuses, such as the printing apparatus 100, the fuser can be run at, or close to, the same process speed as the image transfer system including the photoreceptor belt. In printing apparatuses, print speed may be expressed as the volume of pages (sheets) that may be printed within a certain timeframe, or this page rate may be expressed as a liner rate per unit time, e.g., mm/s, where a page length is converted to a length unit (e.g., millimeters) and then expressed as a process speed. When the fuser is run at, or close to, the same process speed as the image transfer system, sheets leave the image transfer zone and move at an equivalent speed through the fuser nip. Successive sheets are separated from each other during transport. As used herein, the term "inter-document zone" (IDZ) means the distance between successive (adjacent) sheets in the process direction in the apparatus. The inter-document zone is used to allow the printing apparatus 100 to perform calibrations, such as color adjustments, between successive sheets. When the fuser is run at, or close to, the same process speed as the image transfer system, the inter-document zone remains constant. An inter-document zone is not needed for calibration purposes beyond the image transfer system.

However, the inter-document zone between successive sheets results in a thermal differential developing about the outer circumference of the fuser roll. The thermal differential is developed by the change in the thermal load in contact with the outer surface (or "fusing surface") of the fuser roll or fuser belt that occurs during the passage of successive sheets through the nip. For example, when the fusing surface is maintained at a temperature of about 365° F., when paper enters the nip at a temperature of about 70° F., thermal energy is transferred across a temperature gradient of about 295° F. (i.e., 365° F.-70° F.). When an inter-document zone between successive sheets occurs at the nip, the fusing surface contacts the pressure roll at the inter-document zone. When the pressure roll surface temperature is, e.g., about 220° F., the fusing surface thermal energy transfer is across a lower temperature gradient of about 145° F. (i.e., 365° F.-220° F.). Consequently, a lower heat transfer load occurs at the nip when the inter-document zone occurs there as compared to the fuser roll/sheet heat transfer load. Consequently, as the fuser roll rotates through the nip, the portion of the fusing surface that contacts the pressure roll, when the inter-document zone occurs, has a higher temperature than a different portion of the fusing surface that contacted paper. It has been noted that this temperature difference at different portions of the fusing surface can produce undesirable image gloss and associated image defects on sheets passed through the fuser nip.

It has further been noted that in belt fusers including a pressure roll and fuser belt forming a nip, temperature differences can occur at different portions of the fuser belt outer surface ("fusing surface") due to the thermal loading conditions produced by inter-document zones between successive sheets. These temperature differences can also result in undesirable image gloss and associated image defects on sheets that pass through the fuser.

Apparatuses useful for printing that can reduce such temperature differences are provided. Embodiments of the apparatuses can include a marking device for applying a marking material to media, and a fixing device for fixing the marking material on the media. The marking devices can apply solid or liquid marking materials to form images on the media. The fixing devices can apply thermal energy and/or pressure to fix the marking material.

Embodiments of the fixing devices can include opposed members that form a nip at which marking material, which has been applied to media, is treated to fix the marking material. In embodiments, one of the members can be driven and the other member can drive the driven member. The members can be opposed rolls, opposed belts, or an opposed roll and belt. The opposed members can apply thermal energy and/or pressure to media to fix marking material on the media.

Figure 2:
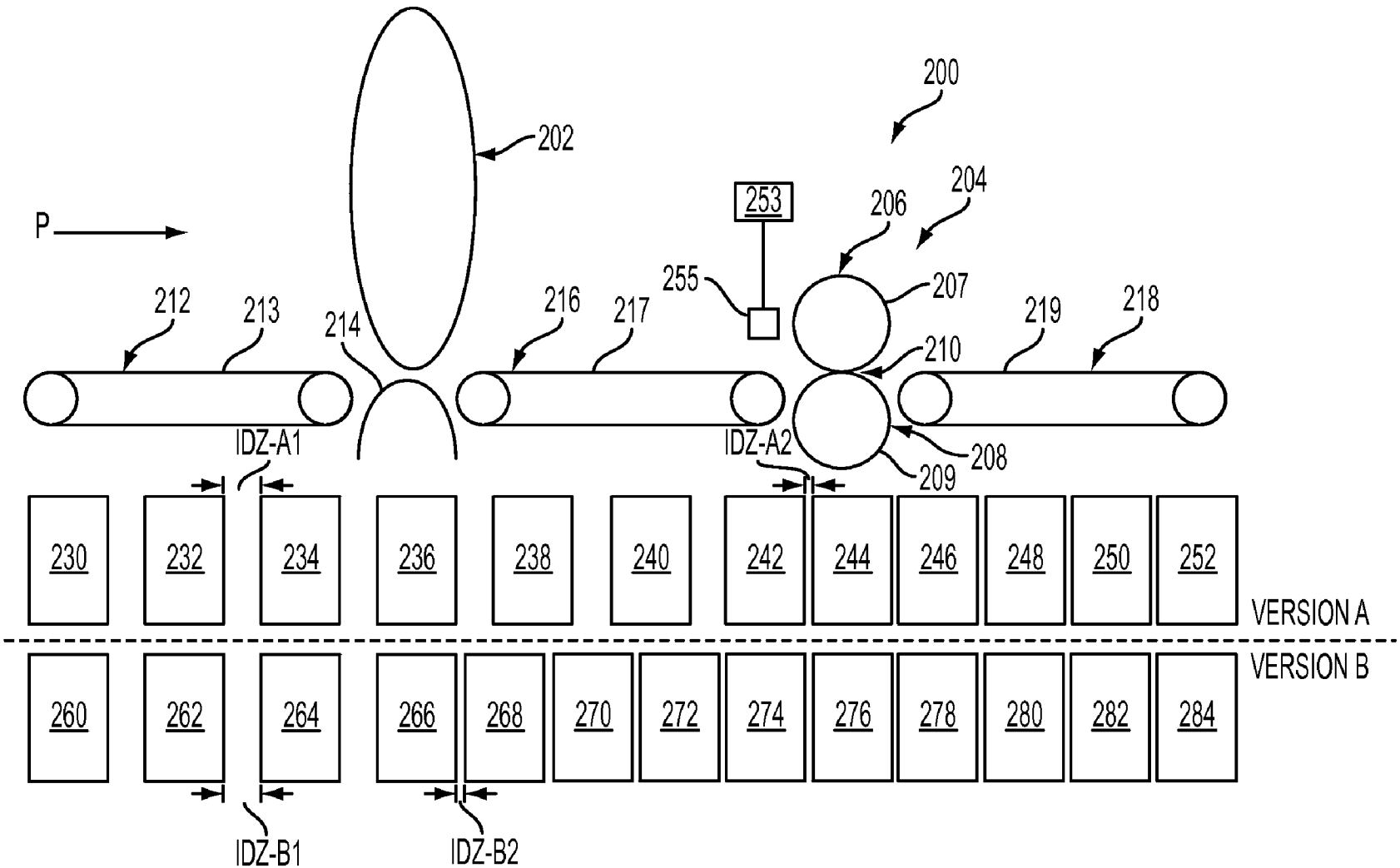
FIG. 2 depicts an exemplary embodiment of an apparatus useful in printing including opposed rolls forming a nip.

FIG. 2 illustrates an apparatus 200 useful in printing according to an exemplary embodiment that can reduce temperature differences at different portions of the fusing surface. Embodiments of the apparatus 200 can be used in various types of printing apparatuses, e.g., in the printer module 106 of the printing apparatus 100 shown in FIG. 1.

The embodiment of apparatus 200 shown in FIG. 2 includes a marking device having a rotatable belt 202 (e.g., a photoreceptor belt). The fixing device is a fuser 204 positioned downstream from the marking device. The fuser 204 includes a fuser roll 206 and a pressure roll 208 together forming a nip 210 through which media are transported. In embodiments, the fuser roll 206 can be a drive roll and the pressure roll a driven roll, for example. The fuser roll 206 includes an outer surface 207 (or fusing surface) and the pressure roll 208 includes an outer surface 209. The fuser roll 206 can include one or more internal heating elements, such as heating lamps, which are powered to heat the outer surface 207 to the desired temperature. Media are fed to the nip 210 where the fuser roll 206 and pressure roll 208 apply sufficient heat and pressure to the media to fix marking material that has been applied on the media.

As shown, the apparatus 200 includes a pre-transfer (registration) transport device 212 for transporting media to the belt 202. In the illustrated embodiment, the pre-transfer transport device 212 includes a rotatable belt 213. In other embodiments, the pre-transfer transport device 212 can include opposed rollers for transporting media to the belt 202. Images are transferred from the belt 202 to media at a transfer zone 214.

A pre-fuser transport device 216 transports the media to which images have been transferred to the fuser 204. In the illustrated embodiment, the pre-fuser transport device 216 includes a rotatable belt 217. In other embodiments, the pre-fuser transport device 216 can include opposed rollers for transporting media to the fuser 204.

A post-fuser transport 218 transports the media that have passed through the fuser 204. In the illustrated embodiment, the post-fuser transport device 218 includes a rotatable belt 219. In other embodiments, the post-fuser transport device 218 can include opposed rollers for transporting media.

In embodiments, the pre-transfer transport device 212, belt 202, pre-fuser transport device 216, fuser 204 and post-fuser transport device 218 can each include an independent drive system for controlling the speed of these respective subsystems. The speeds of the pre-transfer transport device 212, pre-fuser transport device 216, and post-fuser transport device 218 can be adjusted to accelerate or decelerate transport of media. The drive systems can be connected to a controller 253 configured to control each of the drive systems.

The apparatus 200 includes a media sensor 255 connected to the controller 253. The media sensor 255 is positioned to sense media transported on the pre-fuser transport device 216. In embodiments, a media sensor can be positioned to sense media transported on the pre-transfer transport device 212. The media sensor 255 can be connected to the controller 253 and a system computer (not shown). The system computer can schedule media (sheets) needed to complete a print job. Once the media size is known, then the number of print images per belt revolution is known and the relative inter-document zone size is known.

The apparatus 200 provides different modes of operation to reduce the inter-document zone. For example, the apparatus 200 can be operated according to Version A, in which the fuser 204 is run at a slower speed than the belt 202 to reduce the inter-document zone. FIG. 2 shows media 230, 232, 234, which are transported on the pre-transfer transport device 212 to the transfer zone 214; medium 236 positioned at the transfer zone 214; media 238, 240, 242, which are transported on the pre-fuser transport device 216 toward the nip 210 of the fuser 204; medium 244 positioned at the nip 210; and media 246, 248, 250, 252, which are transported on the post-fuser transport 218. In Version A, media are transported on the pre-transfer transport device 212 and pre-fuser transport device 216 to the fuser 204 with an inter-document zone, IDZ-A1, between successive media (e.g., media 242, 240; 234, 232) in process direction P. Typically, IDZ-A1 can be more than about 5 mm. The transport speed of the media 230, 232, 234, 236, 238, 240 and 242 is based on the speed of the belt 202, and the transport speed of media 244, 246, 248, 250 and 252 is based on the speed of the fuser roll 206. Slowing the fuser 204 to run slower than the belt 202 reduces the inter-document zone between the medium 244 at the nip 210 and the succeeding medium 242 arriving at the nip 210 from IDZ-A1 to IDZ-A2. Typically, IDZ-A2 can be more than about 3 mm. The media 246, 248, 250, 252 transported on the post-fuser transport device 218 are spaced from each other by the shorter inter-document zone, IDZ-A2.

The speed of the fuser 204 can be characterized by the nip dwell time, which equals the amount of time that a medium contacts the outer surface 207 of fuser roll 206 as the medium passes through the nip 210. Slowing the speed of the fuser 204 increases the nip dwell time.

Reducing the inter-document zone between successive sheets entering the nip 210 to a desired value allows the apparatus 200 to more closely simulate a continuous stream of paper passing through the nip 210. As a result, the amount of time that the outer surface 207 of the fuser roll 206 contacts the outer surface 209 of the pressure roll 208 during a print job is reduced. The thermal loading of the outer surface 207 of fuser roll 206 becomes increasingly constant as media passing through the nip 210 increasingly simulate a continuous stream of paper, i.e., as the inter-document zone between successive sheets passing through the nip 210 is further reduced. Consequently, temperature differences between different portions of the outer surface 207 can be reduced, the temperature about the circumference of the outer surface 207 can be more uniform, and image gloss produced on sheets passing through the nip 210 can be more uniform, by reducing the inter-document zone between successive sheets to simulate a continuous stream of paper.

In exemplary Version B depicted in FIG. 2, the belt 202 is run at a faster speed than the fuser 204 to reduce the inter-document zone of sheets passing through the nip 210. For example, the fuser 204 can be run at its rated speed or nominal dwell time and the speed of belt 202 increased to run faster than the fuser 204. As used herein, the term "rated speed" means the maximum speed that achieves sufficient fix of marking material to media. FIG. 2 shows media 260, 262, 264, which are transported on the pre-transfer transport device 212 to the transfer zone 214; medium 266 positioned at the transfer zone 214; media 268, 270, 272, 274, which are transported on the pre-fuser transport device 216 toward the nip 210 of the fuser 204; medium 276 at nip 210; and media 278, 280, 282, 284, which are transported on the post-fuser transport 218. In Version B, succeeding media upstream of medium 266 being transported on the pre-transfer transport device 212 are separated from each other by an inter-document zone, IDZ-B1. The inter-document zone IDZ-B1 can be equal to the inter-document zone, IDZ-A1, as shown, or can be different. The transport speed of the media 260, 262, 264 and 266 is based on the speed of the belt 202, and the transport speed of media 268, 270, 272, 274 and 276 is based on the speed of the fuser roll 206. Increasing the speed of the belt 202 relative to the speed of the fuser 204 decreases the inter-document zone between adjacent media downstream of medium 266 from IDZ-B1 to IDZ-B2, as shown. The inter-document zone IDZ-B2 can be equal to the inter-document zone, IDZ-A2, as shown, or can be different. The increased speed of belt 202 can produce additional throughput, while the dwell time at nip 210 can be maintained at the rated dwell time of, e.g., about 30 ms. As used herein, the term "rated dwell time" means the minimum dwell time that achieves sufficient fix of marking material to media at the rated speed of the fuser 204.

In Version B, the pre-fuser transport device 216 positioned between the transfer zone 214 and the fuser 204 provides the increase in media transport speed to reduce the distance between the edges of successive sheets. In embodiments, the media sensor 255 can time changes between sheets being transported to allow a speed adjustment to be sent to the controller 253 to execute the speed change. In Version B, the printing speed can be increased while achieving effective heat transfer to marking material at the nip 210 to achieve the desired fix level of the marking material to media.

By reducing the inter-document zone between sheets, after transfer, the fusing speed can be reduced without reducing the number of prints made by the printing apparatus. The benefit of the closer spacing between sheets offers multiple options. In reducing the inter-document zone, an optimal balance between increased productivity and increased dwell time can be achieved.

In embodiments, increasing the dwell time allows the fuser 204 to be operated at a lower temperature and still be able to supply sufficient thermal energy to media to treat marking material. Lowering the fuser temperature can reduce energy consumption in printing apparatuses.

In other embodiments, the increased dwell time (i.e., slower speed) of media passing through the nip 210 of fuser 204 can be used to increase the level of fix of images to media. The additional time that media are present at the nip 210 at the increased dwell time allows additional thermal energy to be applied to the media to increase the level of fix. For example, when it is determined that media are not receiving a sufficient level of fix, the fuser 204 can be slowed down from its rated speed to run slower than the photoreceptor belt (such as in Version A), or the photoreceptor belt can be sped up to run faster than the fuser (such as in Version B). When the media are receiving a sufficient level of fix at the rated speed of the fuser 204, the controller 253 can cause the photoreceptor belt 202 and fuser 204 to run at about the same speed. Accordingly, the feature of reducing the inter-document zone between sheets during print runs can be selectively turned ON or OFF.

Figure 3:
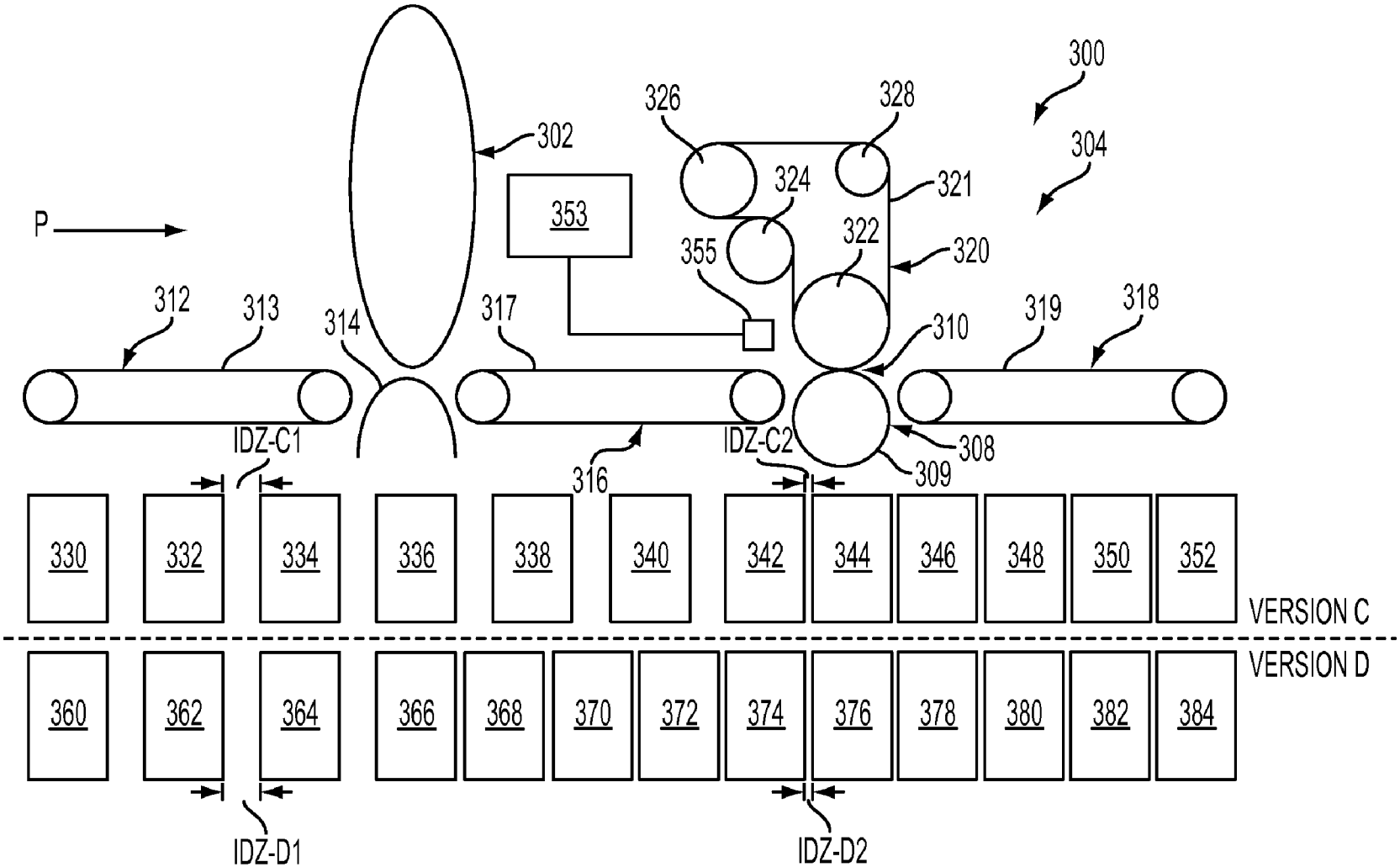
FIG. 3 depicts another exemplary embodiment of an apparatus useful in printing including a belt and roll forming a nip.

FIG. 3 illustrates an apparatus 300 useful in printing according to another exemplary embodiment that can reduce temperature differences on the fusing surface of the fixing device. Embodiments of the apparatus 300 can be used in different types of printing apparatuses, such as in the printer module 106 of the printing apparatus 100 shown in FIG. 1.

The apparatus 300 includes a marking device having a rotatable belt 302 (e.g., a photoreceptor belt). The fixing device is a fuser 304 positioned downstream from the marking device. The fuser 304 includes a fuser belt 320 having an outer surface 321. The fuser belt 320 is supported on a fuser roll 322, an external roll 324 and internal rolls 326, 328. A pressure roll 308 including an outer surface 309 forms a nip 310 with the fuser belt 320. In embodiments, the fuser belt 320 can drive the pressure roll 308, for example.

One or more of the fuser roll 322, external roll 324 and internal rolls 326, 328 can include an internal heat source, such as one or more heating lamps, operable to heat the fuser belt 320. Media are fed to the nip 310 formed by the outer surfaces 321, 309 where the fuser belt 320 and pressure roll 308 apply heat and pressure to the media to treat marking material on the media.

As shown, the apparatus 300 includes a pre-transfer (registration) transport device 312 for transporting media to the belt 302. In the illustrated embodiment, the pre-transfer transport device 312 includes a rotatable belt 313. In other embodiments, the pre-transfer transport device 312 can include opposed rollers for transporting media to the belt 302. Images are transferred from the belt 302 to media at a transfer zone 314.

A pre-fuser transport device 316 transports the media to which images have been transferred to the fuser 304. In the illustrated embodiment, the pre-fuser transport device 316 includes a rotatable belt 317. In other embodiments, the pre-fuser transport device 316 can include opposed rollers for transporting media to the fuser 304.

A post-fuser transport 318 transports the media that have passed through the fuser 304. In the illustrated embodiment, the post-fuser transport device 318 includes a rotatable belt 319. In other embodiments, the post-fuser transport device 318 can include opposed rollers for transporting media.

The apparatus 300 includes a media sensor 355 connected to a controller 353. The media sensor 355 is positioned to sense media transported on the pre-fuser transport device 316. In embodiments, a media sensor can be positioned to sense media transported on the pre-transfer transport device 312. The media sensor 355 can be connected to a system computer (not shown).

The transport speed of the media 330, 332, 334, 336, 338, 340 and 342 is based on the speed of the belt 302, and the transport speed of media 344, 346, 348, 350 and 352 is based on the speed of the fuser belt 320.

As depicted in FIG. 3, the apparatus 300 provides different modes of operation to reduce the inter-document zone. For example, as shown, the apparatus 300 can be operated according to Version C, in which the fuser 304 is run at a slower speed than the belt 302 to reduce the inter-document zone. Media 330, 332, 334, 336, 338, 340, 342 are transported on the pre-transfer transport device 312 and pre-fuser transport device 316 to the fuser 304 with an inter-document zone, IDZ-C1, between successive media (e.g., media 342, 340; 334, 332) in process direction P. Slowing the fuser belt 320 to run slower than the belt 302 reduces the inter-document zone between the medium 344 at the nip 310 and the adjacent medium 342 to IDZ-C2. The media 346, 348, 350, 352 transported on the post-fuser transport device 318 are spaced from each other by the reduced inter-document zone, IDZ-C2.

By reducing the inter-document zone between sheets entering the nip 310, the amount of time that the outer surface 321 of the fuser belt 320 contacts the outer surface 309 of the pressure roll 308 can be reduced. Consequently, temperature differences between different portions of the outer surface 321 can be reduced, and the temperature about the length of the outer surface 321 can be made more uniform, by reducing the inter-document zone between successive sheets during printing.

As depicted in FIG. 3, in Version D, the belt 302 is run at a faster speed than the fuser 304 to reduce the inter-document zone. For example, the fuser 304 can be run at its rated speed or nominal dwell time and the speed of belt 302 increased to run faster than the fuser 304. In Version D, succeeding media upstream of medium 376 transported on the pre-transfer transport device 312 are spaced from each other by an inter-document zone, IDZ-D1. Inter-document zone IDZ-D1 can be equal to inter-document zone, IDZ-C1, for example. By increasing the speed of the belt 302 relative to the speed of the fuser 304, the inter-document zone between succeeding media downstream of medium 366 is reduced from IDZ-D1 to IDZ-D2. Inter-document zone IDZ-D2 can be equal to inter-document zone, IDZ-C2, for example. The increased speed of belt 302 can provide additional throughput, while keeping the dwell time at nip 310 at a value of, e.g., about 30 ms.

In Version D, the pre-fuser transport device 316 between the transfer zone 314 and the fuser 304 provides the increase in speed to reduce the distance between the edges of successive sheets. In embodiments, the media sensor 355 can time changes between sheets being transported to allow a speed adjustment to be sent to the controller 353 to execute the speed change.

In other embodiments of the apparatuses useful in printing, the opposed members forming a nip at which marking material on media is treated can both be belts having opposed outer surfaces. At least one of the belts can be heated to heat the marking material at the nip. In such embodiments, the belts can be slowed down to reduce the inter-document zone of media passing through the nip, such as in Versions A and C depicted in FIGS. 2 and 3. In such apparatuses, a photoreceptor belt, or the like, positioned upstream of the nip in the process direction, can be run at a faster speed than the belts forming a nip to reduce the inter-document zone, such as in Versions B and D depicted in FIGS. 2 and 3. For example, the belts can be run at a rated speed and the speed of photoreceptor belt increased to run faster than the belts to reduce the inter-document zone.

In embodiments, the apparatus useful in printing include an imaging device other than a photoreceptor belt, such as a photoreceptor roll or drum, for producing images on media. The speed of the photoreceptor roll or drum can be adjusted by a controller to change the inter-document zone prior to the nip.

EXAMPLE

An apparatus useful in printing including a photoreceptor belt and a fuser including a fuser roll and pressure roll forming a nip was modeled. The following nominal conditions were used in the model: fusing speed (photoreceptor belt and fuser): 532 mm/s, fuser nip width: 15 mm, nip dwell time: 28.2 ms, and inter-document zone: 32 mm.

In the model, the fuser is run at a slower speed than the photoreceptor belt to reduce the inter-document zone between successive sheets from 32 mm to 8 mm between the photoreceptor belt and the fuser, as depicted in FIG. 2 for version A.

TABLE 1 shows photoreceptor belt (PR) pitches ranging from 4 to 12 and corresponding print speeds (pages/min) at the nominal value of the inter-document zone. For each pitch, the print speed (i.e., PR belt speed) is reduced at the reduced inter-document zone with the sheets being more closely spaced from each other. For each photoreceptor belt pitch, the print speed is increased back to the nominal value of 532 mm/s. The print speed increase ranges from 16.9% at a PR belt pitch of 12 to 4.7% at a PR belt pitch of 4.

TABLE 1

| | PR Belt Pitch | | | | | | | | |
|---|---|---|---|---|---|---|---|---|---|
| | 12 | 11 | 10 | 9 | 8 | 7 | 6 | 5 | 4 |
| Print Speed [pages/min] | 120 | 110 | 100 | 90 | 80 | 70 | 60 | 50 | 40 |
| Image + Nominal IDZ [mm] | 229.5 | 250.4 | 275.4 | 306 | 344.3 | 393.4 | 459 | 550.8 | 688.5 |
| Print Time/ Page [s] | 0.43 | 0.47 | 0.52 | 0.58 | 0.65 | 0.74 | 0.86 | 1.04 | 1.3 |
| Image Length [mm] | 182.6 | 203.7 | 228.6 | 259.1 | 297.2 | 345.7 | 411.0 | 510.9 | 648.5 |
| Image + Reduced IDZ [mm] | 190.6 | 211.7 | 236.6 | 267.1 | 305.2 | 353.7 | 419.0 | 518.9 | 656.5 |
| Image + Reduced IDZ Print Speed [mm/s] | 441.9 | 449.9 | 457.0 | 464.3 | 471.6 | 478.3 | 485.6 | 501.2 | 507.3 |
| Print Speed Increase [%] | 16.9 | 15.4 | 14.1 | 12.7 | 11.4 | 10.1 | 8.7 | 5.8 | 4.7 |
| Increased Nip Dwell Time [ms] | 33.0 | 32.5 | 32.2 | 31.8 | 31.4 | 31.0 | 30.7 | 29.8 | 29.5 |

As shown in TABLE 1, reducing the inter-document zone for sheets increases the nip dwell time at each pitch to above the nominal value. As shown in TABLE 2, when the nip dwell time is set to the nominal value, and the photoreceptor belt speed is increased to compensate for the nominal fusing speed setting, the resulting print speed is increased from 1.9 pages/min at a PR belt pitch of 4 to 20.3 pages/min at a PR belt pitch of 12.

TABLE 2

| | PR Belt Pitch | | | | | | | | |
|---|---|---|---|---|---|---|---|---|---|
| | 12 | 11 | 10 | 9 | 8 | 7 | 6 | 5 | 4 |
| Adjusted Fusing Speed [mm/s] | 622.1 | 614.1 | 607.0 | 600.0 | 592.4 | 585.7 | 578.4 | 562.8 | 556.7 |
| Print Speed | 140.3 | 127.0 | 114.1 | 101.5 | 89.1 | 77.1 | 65.2 | 52.9 | 41.9 |

In other embodiments, the print speed can be further increased by further reducing the inter-document zone.

Although the above description is directed toward fuser apparatuses used in xerographic printing, it will be understood that the teachings and claims herein can be applied to any treatment of marking material on a medium. For example, the marking material applied on media can be toner, liquid or gel ink, and/or heat- or radiation-curable ink; and/or the media can utilize certain process conditions, such as temperature, for successful printing. The process conditions, such as heat, pressure and other conditions that are desired for the treatment of ink on media in a given embodiment may be different from the conditions suitable for xerographic fusing.

It will be appreciated that various ones of the above-disclosed, as well as other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. An apparatus useful in printing, comprising:

a marking device;

a first transport device adapted to transport a first medium and a successive second medium to the marking device in a process direction with the first medium and second medium separated from each other by a first inter-document zone in the process direction;

a fixing device comprising a first member including a first outer surface and a second member including a second outer surface forming a nip with the first outer surface;

a second transport device adapted to transport the first medium and second medium from the marking device to the nip; and a controller configured to control an adjustable speed of the marking device, an adjustable speed of the first member and a adjustable speed of the second transport device to reduce the first inter-document zone between the first medium and second medium to a second inter-document zone in the process direction between the marking device and the nip.

2. The apparatus of claim 1, wherein the first member is a first roll and the second member is a second roll.

3. The apparatus of claim 1, wherein the first member is a belt and the second member is a roll.

4. The apparatus of claim 1, wherein the first member is a first belt and the second member is a second belt.

5. The apparatus of claim 1, wherein:

the first transport device comprises a first transport belt or first transport rolls for transporting the first medium and second medium to the marking device;

the second transport device comprises a second transport belt or second transport rolls for transporting the first medium and second medium from the marking device to the nip; and the controller is configured to control a speed of the second transport belt or second transport rolls based on the speeds of the marking device and the first member.

6. The apparatus of claim 1, further comprising a media sensor connected to the controller, the media sensor being positioned to sense media transported on the first transport device or the second transport device.

7. The apparatus of claim 1, wherein the speed of the first member is lower than the speed of the marking device.

8. A printing apparatus, comprising:

a marking device;

a first transport device which transports a first medium and a successive second medium to the marking device in a process direction with the first medium and second medium separated from each other by a first inter-document zone in the process direction;

a fuser including a rotatable first member including a first outer surface and a rotatable second member including a second outer surface forming a nip with the first outer surface, at least one of the first outer surface and the second outer surface being heated;

a second transport device which transports the first medium and second medium from the marking device to the nip; and a controller configured to control an adjustable speed of the marking device, an adjustable speed of the first member and an adjustable speed of the second transport device to reduce the first inter-document zone between the first medium and second medium to a second inter-document zone in the process direction between the marking device and the nip.

9. The printing apparatus of claim 8, wherein:

the marking device comprises a photoreceptor;

the first member is a first roll; and the second member is a second roll.

10. The printing apparatus of claim 8, wherein:

the marking device comprises a photoreceptor;

the first member is a belt; and the second member is a roll.

11. The printing apparatus of claim 8, wherein:

the marking device comprises a photoreceptor;

the first member is a first belt; and the second member is a second belt.

12. The printing apparatus of claim 8, wherein:

the first transport device comprises a first transport belt or first transport rolls for transporting the first medium and second medium to the marking device;

the second transport device comprises a second transport belt or second transport rolls for transporting the first medium and second medium from the marking device to the nip; and the controller is configured to control a speed of the second transport belt or second transport rolls based on the speeds of the marking device and the first member.

13. The printing apparatus of claim 8, further comprising a media sensor connected to the controller, the media sensor being positioned to sense media transported on the first transport device or the second transport device.

14. The printing apparatus of claim 8, wherein the speed of the first member is lower than the speed of the marking device.

15. A method of fixing marking material on media, comprising:

transporting a first medium and a successive second medium to a marking device in a process direction with the first medium and second medium separated from each other by a first inter-document zone in the process direction;

applying a marking material to the first medium and second medium with the marking device;

transporting the first medium and second medium from the marking device to a nip formed by a first outer surface of a first member and a second outer surface of a second member; and controlling an adjustable speed of the marking device, an adjustable transport speed of the first medium and second medium from the marking device to the nip, and an adjustable speed of the first member to reduce the first inter-document zone between the first medium and second medium to a second inter-document zone in the process direction between the marking device and the nip.

16. The method of claim 15, wherein the first member is a first roll and the second member is a second roll.

17. The method of claim 15, wherein the first member is a belt and the second member is a roll.

18. The method of claim 15, wherein the first member is a first belt and the second member is a second belt.

19. The method of claim 15, wherein:

the first medium and second medium are transported to the marking device with a first transport belt or first transport rolls;

the first medium and second medium are transported from the marking device to the nip with a second transport belt or second transport rolls; and a speed of the second transport belt or second transport rolls is controlled based on the speeds of the marking device and the first member.

20. The method of claim 15, further comprising heating at least one of the first member and second member to fix the marking material onto media at the nip.

21. The method of claim 15, wherein the speed of the first member is lower than the speed of the marking device.

22. The method of claim 15, wherein the first inter-document zone is more than about 5 mm and the second inter-document zone is more than about 3 mm.

* * * * *